US006631730B1

(12) United States Patent
Bloom et al.

(10) Patent No.: US 6,631,730 B1
(45) Date of Patent: Oct. 14, 2003

(54) QUICK INSTALL FAUCET BODY

(75) Inventors: Mark S. Bloom, Ventura, CA (US); Brian J. Matt, Wellesley; Steven L. Hecker, Waltham, both of MA (US); Ravi K. Sawhney, Calabasas, CA (US); Frank Zinni, Capistrano Beach, CA (US); Kurt Botsai, Thousand Oaks, CA (US)

(73) Assignee: Emhart Inc., Newark, DE (US)

( * ) Notice: Subject to any disclaimer, the term of this patent is extended or adjusted under 35 U.S.C. 154(b) by 497 days.

(21) Appl. No.: 09/616,760

(22) Filed: Jul. 14, 2000

(51) Int. Cl.[7] ..... E03C 1/04

(52) U.S. Cl. ..... 137/359; 4/676; 137/606; 137/801; 285/193

(58) Field of Search ..... 4/676; 137/359, 137/606, 801; 285/193

(56) References Cited

U.S. PATENT DOCUMENTS

| | | | | |
|---|---|---|---|---|
| 3,010,474 | A | | 11/1961 | Moen |
| 3,785,396 | A | | 1/1974 | Morris et al. |
| 3,790,966 | A | | 2/1974 | Keane |
| 4,005,883 | A | | 2/1977 | Guest |
| 4,281,857 | A | | 8/1981 | Randall |
| 4,553,277 | A | | 11/1985 | Duncan |
| 4,654,900 | A | | 4/1987 | McGhee |
| 4,671,316 | A | | 6/1987 | Botnick |
| 4,760,861 | A | | 8/1988 | Botnick |
| 4,762,143 | A | | 8/1988 | Botnick |
| 4,848,395 | A | | 7/1989 | Krippendorf |
| 4,852,192 | A | | 8/1989 | Viegener |
| 4,998,555 | A | | 3/1991 | Barhydt, Sr. et al. |
| 5,127,427 | A | | 7/1992 | Kajpust et al. |
| 5,232,008 | A | | 8/1993 | Jeffress et al. |
| 5,388,287 | A | | 2/1995 | Tischler et al. |
| 5,465,749 | A | | 11/1995 | Sauter et al. |
| 5,515,882 | A | | 5/1996 | Hennis |
| 5,584,513 | A | | 12/1996 | Sweeny et al. |
| 5,946,746 | A | | 9/1999 | Bloom |
| 6,138,296 | A | * | 10/2000 | Baker ..... 4/678 |

FOREIGN PATENT DOCUMENTS

| | | |
|---|---|---|
| EP | 0213656 A1 | 11/1987 |
| FR | 2 525 296 | 10/1983 |

* cited by examiner

*Primary Examiner*—Gerald A. Michalsky
(74) *Attorney, Agent, or Firm*—Harness, Dickey & Pierce, P.L.C.

(57) ABSTRACT

An apparatus is provided for installing a faucet on a top side of a deck. The apparatus includes a threaded member engaged with the faucet and extending through the mounting hole to be rotated from above the deck. A nut is threadedly connected to the threaded member to pass through the mounting hole to the underside of the deck. A second member associated with and parallel to the threaded member engages the nut to prevent rotation thereof during rotation of the threaded member whereby the nut will be shifted up or down along the length of the threaded member. A pair of retaining arms are provided whereby, upon rotation of the threaded member to raise the nut in the direction of the deck, the retaining arms will bend outwardly and engage the underside of the deck to clamp the faucet to the deck.

8 Claims, 10 Drawing Sheets

QUICK INSTALL FAUCET BODY

BACKGROUND OF THE INVENTION

1. Field of the Invention

The present invention relates generally to a faucet assembly, and more particularly, to a quick install faucet assembly which can be mounted from the top of a deck to which the faucet assembly is connected.

2. Background and Summary of the Invention

In conventional faucet assemblies, the mounting of the faucet assembly is completed from, or requires assembly components to be installed from the underside of the deck to which the faucet assembly is mounted. The assembly which is typically required to be performed from the underside of the deck is often awkward and uncomfortable for the installer.

It is an object of the present invention to provide a quick install faucet assembly that is mounted to the deck from above the deck, and that is simple in construction, economical to produce, and highly reliable in operation. It is another object of the present invention to provide a quick install faucet assembly that is easy to assemble or disassemble, as desired. It is still another object of the present invention to provide a quick install faucet assembly for mounting the spout and/or the end bodies of the faucet from above the deck in a quick and easy manner with a minimum of tools or operations.

Accordingly, the present invention provides a quick install faucet assembly, and more specifically, a faucet assembly that is mounted from the top of the deck to which the faucet assembly is connected.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

With reference to the accompanying drawings, the quick install faucet assembly according to the principles of the present invention will be described The quick install faucet assembly described herein includes a spout 10 and a pair of separately mounted end body valve assemblies 12, 14. However, it should be understood that the principles of the present invention may also be applied to a faucet assembly having the spout 10 and valve assemblies 12, 14 as a single unit.

Figure 5:
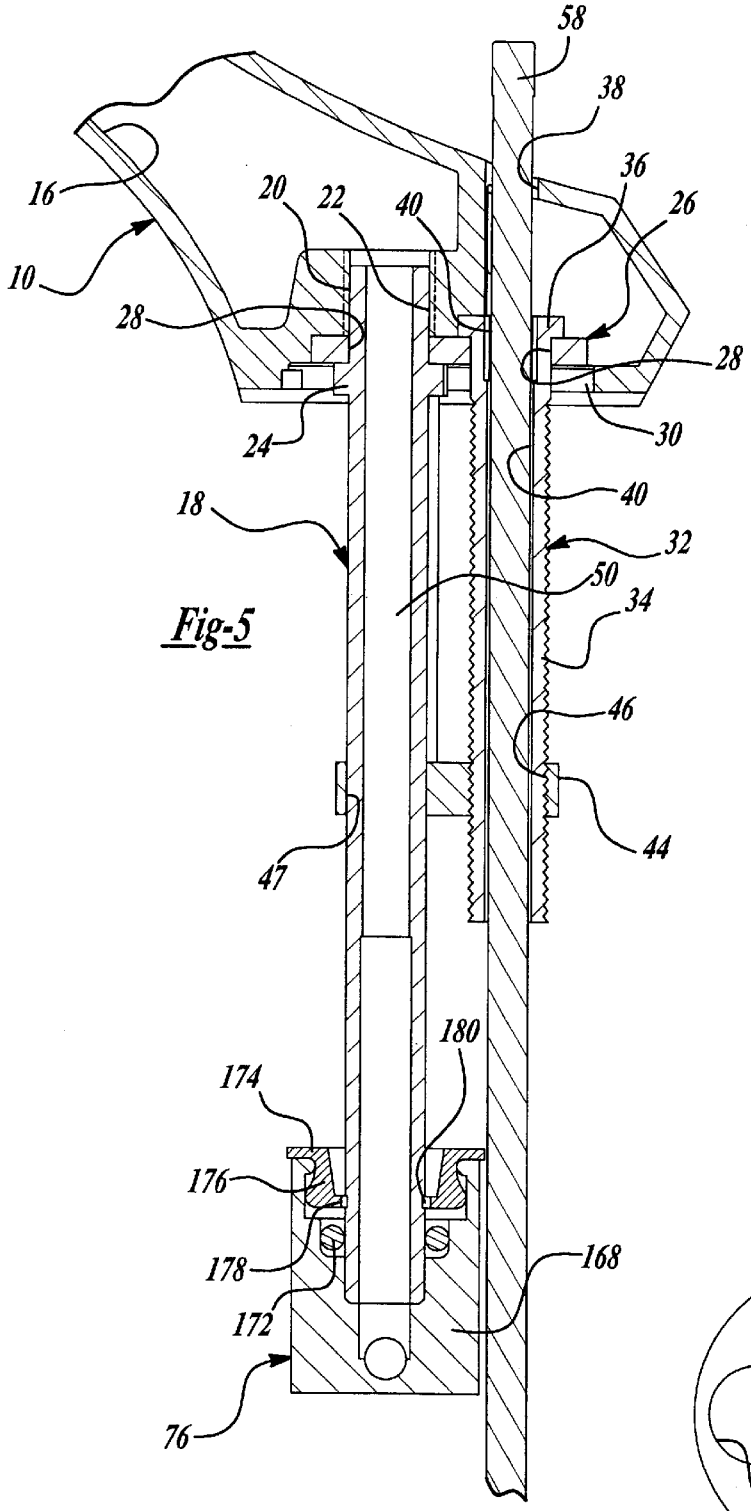
FIG. 5 is a cross-sectional view of the quick install spout assembly according to the principles of the present invention.
Figure 7:
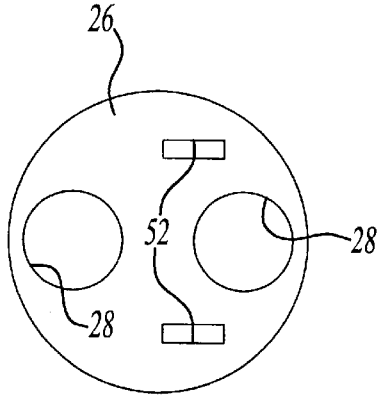
FIG. 7 is a plan view of a mounting bracket for use according to the principles of the present invention.
Figure 8:
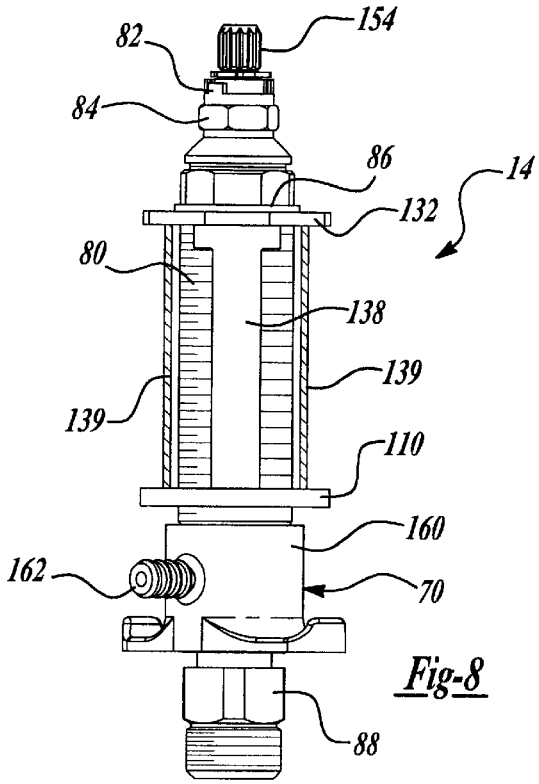
FIG. 8 is a first side view of a quick install end body valve assembly according to the principles of the present invention.
Figure 9:
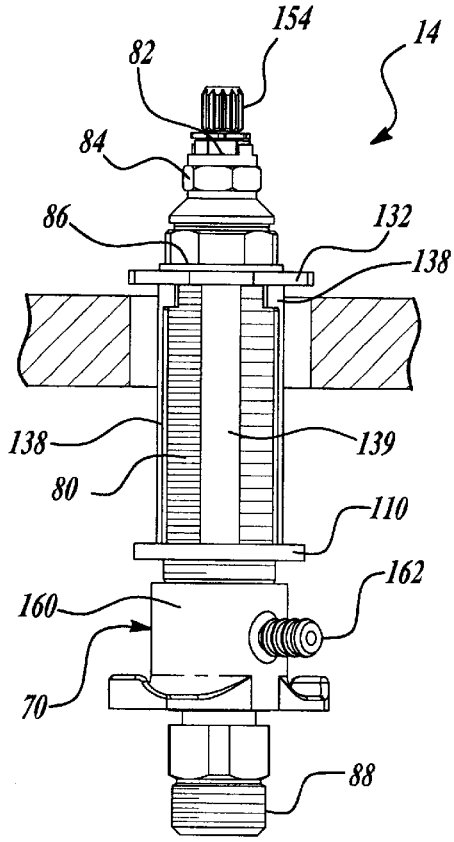
FIG. 9 is a second side view of the end body valve assembly according to the principles of the present invention.
Figure 10:
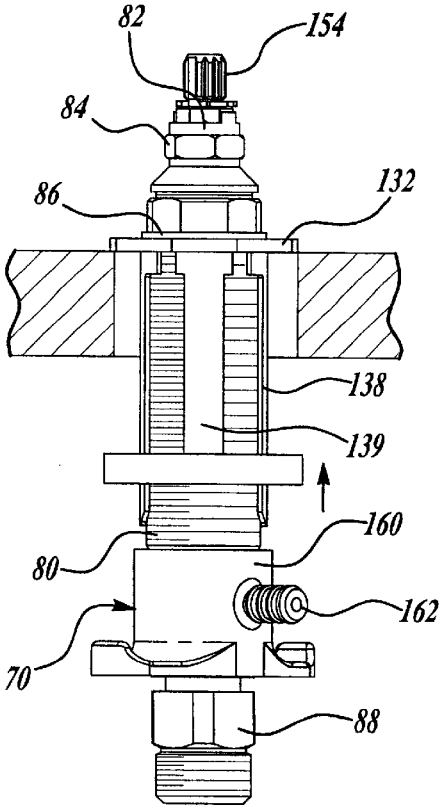
FIG. 10 is a side view of the end body valve assembly inserted in an opening in a deck with the retainer assembly in the disengaged position according to the principles of the present invention.

As shown in FIG. 5, the spout 10 includes a water passage 16 which communicates with a waterway tube 18. The waterway tube 18 has a threaded end portion 20 which engages an internally threaded portion 22 of the spout 10. The waterway tube 18 includes a radially extending hexagonal flange portion 24. A guide bracket 26 is provided with a pair of openings 28, as shown in FIG. 7, and receives the threaded portion 20 of the waterway tube 18 through one of the openings 28. The radially extending flange portion 24 supports the guide bracket 26 within a lower cavity 30 defined within the spout 10. The threaded portion 20 of waterway tube 18 is engaged with the internally threaded portion 22 of spout 10. As is known in the art, a Teflon® tape, thread sealant or other seal means, can be provided on the threaded portion 20 of the waterway tube 18 in order to provide a water sealed fit.

A threaded rod 32 is provided with a hollow cylindrical body 34 which is externally threaded and is provided with an upper radially extending flange 36. The threaded rod 32 extends through the second opening 28 in guide bracket 26 while flange 36 rests against the guide bracket 26. The threaded rod 32 is aligned with an opening 38 in the spout 10 which allows access of an allen wrench for engaging an internal hexagonal engagement portion 40 provided in the upper portion of the threaded rod 32. In the completed faucet assembly, a pop-up rod 58 extends through the central opening of the threaded rod 32 and through the opening 38 in spout 10. As is well known in the art, the pop-up rod 58 engages a drain stopper assembly (not shown) for opening and closing the drain stopper.

Figure 3:
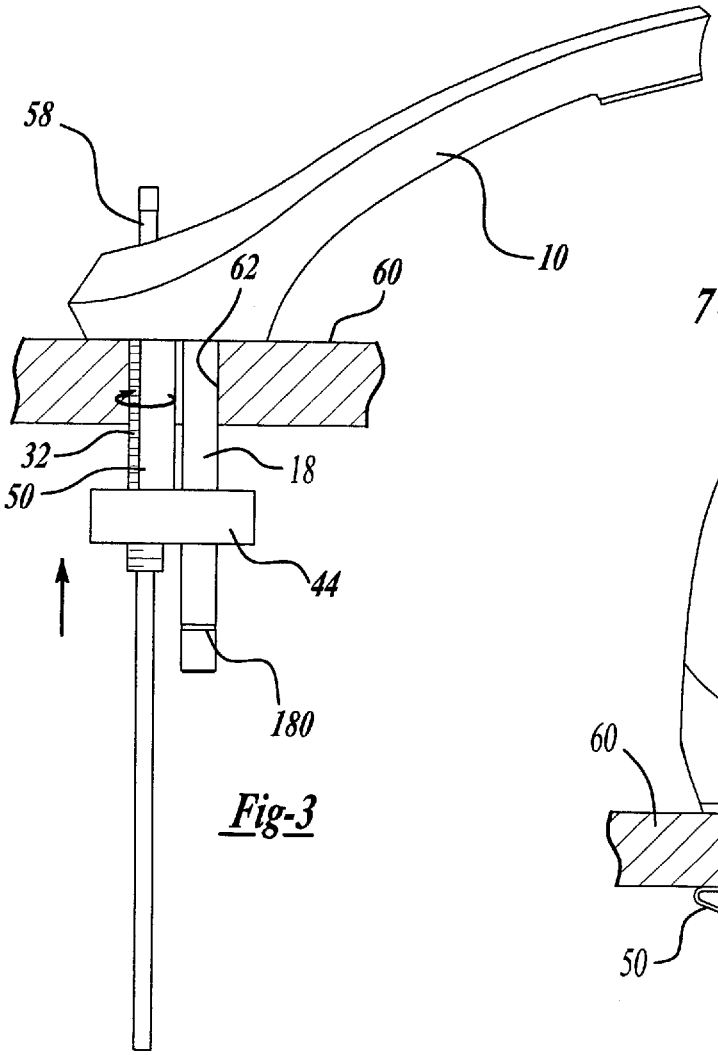
FIG. 3 is a side view of the spout assembly inserted in an opening in the deck with the retainer assembly in the disengaged position, according to the principles of the present invention.
Figure 4:
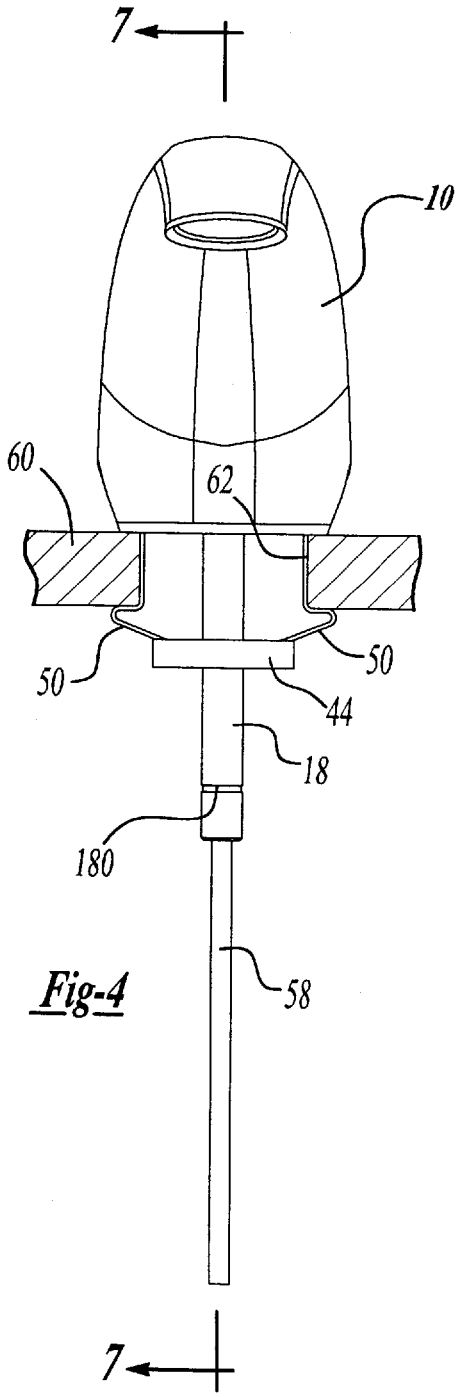
FIG. 4 is a front view of the spout assembly with the retainer assembly in the engaged position for engaging the deck, according to the principles of the present invention.
Figure 6:
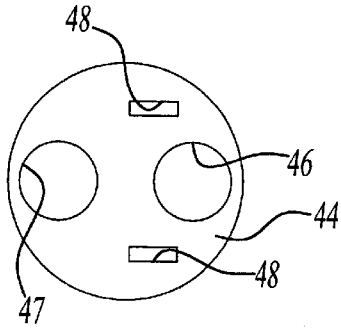
FIG. 6 is a plan view of the spout nut, according to the principles of the present invention.

With reference to FIGS. 3 and 4, the spout 10 is provided with a retainer assembly 42. The retainer assembly 42 includes a nut member 44 which is threadedly engaged with the threaded rod 32. As best shown in FIG. 6, the nut member 44 includes a threaded opening 46 which engages the threaded rod 32 and a second opening 47 which slidably receives the waterway tube 18. The nut member 44 also includes two retainer arm receiving holes 48 disposed on opposite sides of the threaded opening 46. A pair of generally parallel retainer arms 50 are mounted to the nut member 44 and extend between the nut member 44 and the guide bracket 26. The guide bracket 26 includes a pair of slots 52 (as shown in FIG. 7) for receiving the ends of the arms 50.

With reference to FIGS. 3 and 4, the installation of the spout 10 according to the principles of the present invention will now be described. The spout 10 is mounted to a deck or mounting surface 60 which is provided with an opening 62 for receiving the threaded rod 32 and waterway tube 18 of the spout assembly. As shown in FIG. 3, the retainer assembly 42 is in a disengaged position with the retainer arms 50 being generally straight.

At this point, an alien wrench can be inserted through the opening 38 in the spout 10 to engage the hexagonal portion 40 of the threaded rod 32. The threaded rod 32 can then be turned in order to draw the nut member 44 of the retainer assembly 42 in an upward direction so that the retainer arms 50 of the retainer assembly 42 bend outward to engage the underside of the deck 60 at two points spaced about opening 62, as best shown in FIG. 4. The retainer arms 50 are preferably made from steel or other bendable material. The retainer arms 50 can be scored in order to facilitate bending in a specific location. The retainer arms 50 can be suspended between the nut member 44 and guide bracket 26. The pop-rod 58 is slidably received in the opening in the threaded rod 32 and can be easily removed so that the allen wrench can be inserted through the opening 38 of spout 10 to engage the hexagonal portion 48 of the threaded rod 32.

Figure 1:
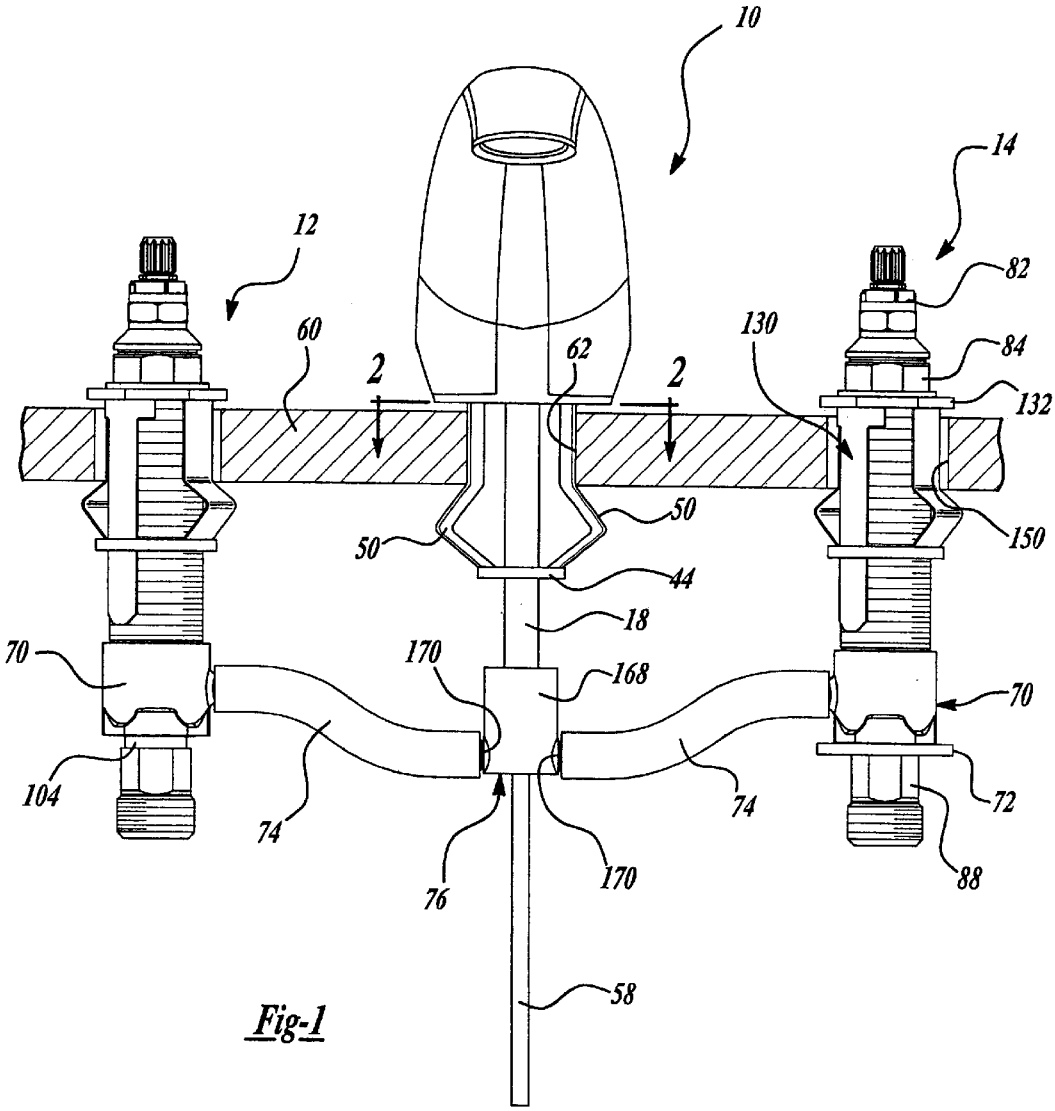
FIG. 1 is a front view of the quick install faucet assembly according to the principles of the present invention.
Figure 2:
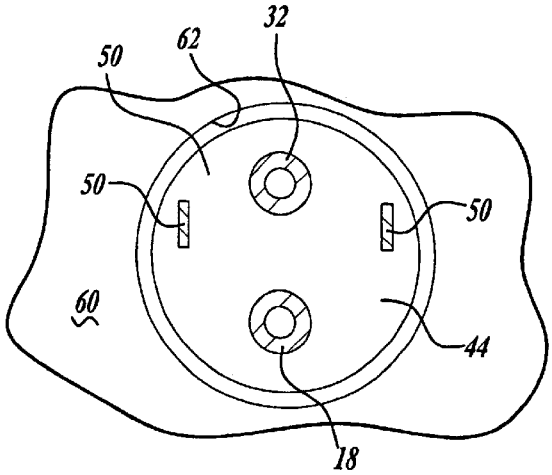
FIG. 2 is a cross-sectional view taken along line 2—2 of FIG. 1.

As shown in FIG. 1, the quick install faucet assembly of the present invention is provided with first and second end body valve assemblies 12, 14. One of the end body valve assemblies 12 is provided for the hot water line while the other of the end body valve assemblies 14 is for the cold water supply line. Each end body valve assembly 12, 14 is provided with an end connector 70, secured in place by a connector clip 72, for communicating water via interconnecting hoses 74 to the T-joint connector 76 mounted to the waterway tube 18 of spout assembly 10.

Figure 14:
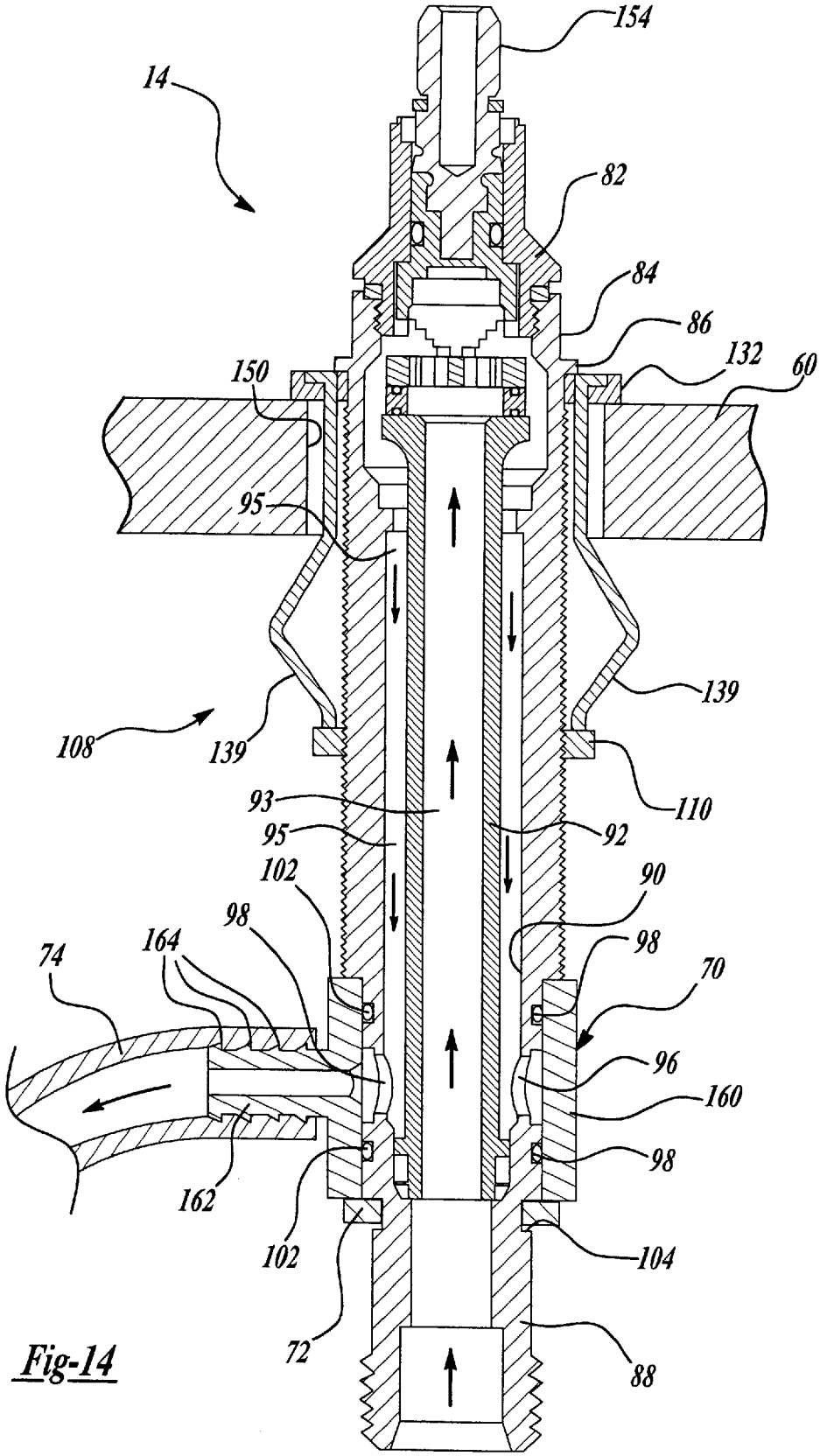
FIG. 14 is a cross-sectional view of the end body valve assembly according to the principles of the present invention.
Figure 15:
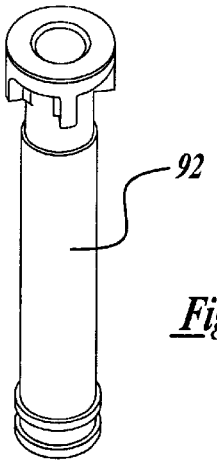
FIG. 15 is a perspective view of the spacer tube for use with the end body valve assembly according to the principles of the present invention.

With reference to FIG. 14, end body valve assembly 14 will be described. It should be understood that the end body valve assemblies 12, 14 have identical configurations and that a separate detailed description of each valve assembly is unnecessary. The end body valve assembly 14 includes a threaded body 80 mounted to a shut-off valve 82. The threaded body 80 includes an upper hexagonal head portion 84 provided with a radially extending flange 86 below the hexagonal head portion 84. The threaded body 80 also includes a hollow longitudinally extending base portion 88 which defines the waterflow path as best shown in FIG. 14. The threaded body 80 has a hollow central portion 90 which receives a spacer tube 92 (shown in FIG. 15). Spacer tube 92 has a hollow opening therethrough which defines the central flowpath 93 which communicates fluid through the shut-off-valve 82. The shut-off valve 82 communicates water from the waterflow path 93 to a concentrically formed waterflow path 95 between the threaded body 80 and spacer tube 92 to communicate water to radially extending openings 96 in the base portion 88 of the threaded body 80. The openings 96 communicate with the end connector 70 for communicating fluid through the interconnecting hose 74. The base portion 88 of threaded body 80 is provided with radial grooves 98 for supporting O-rings 102 between the base portion 88 and the end connector 70 for providing a water-tight fit between the end connector 70 and the threaded body 80. The base portion 88 of the threaded body 80 includes a recessed area between the O-rings 102 for water flow. The base portion 88 also includes a groove 104 for receiving a retaining clip 72, as shown in FIGS. 1 and 14.

Figure 12:
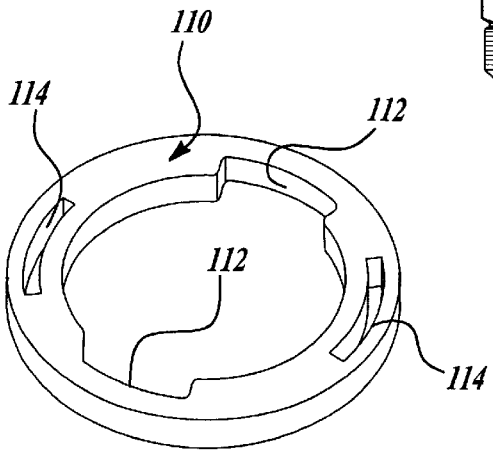
FIG. 12 is a perspective view of the threaded nut for use with the end body valve assembly according to the principles of the present invention.
Figure 13:
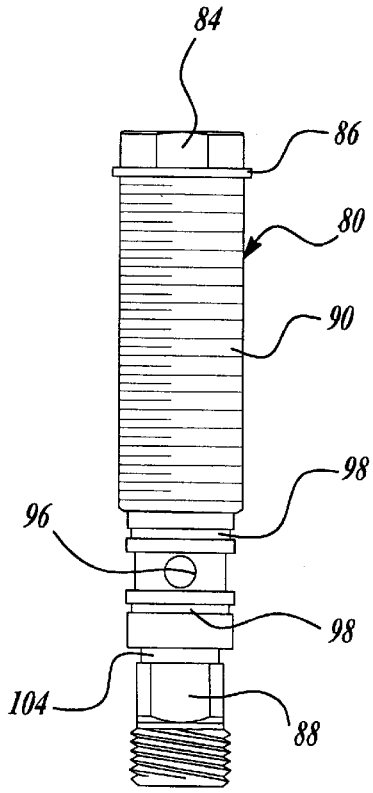
FIG. 13 is a side view of the threaded body for use with the end body valve assembly according to the principles of the present invention.

The end body valve assembly 14 includes a retainer assembly 108. The retainer assembly 108 includes a threaded nut 110 which is threadedly engaged with the threaded body 80. Threaded nut 110, as best shown in FIG. 12, is provided with a pair of oppositely disposed guide recesses 112 and a pair of arm receiving slots 114.

Figure 11:
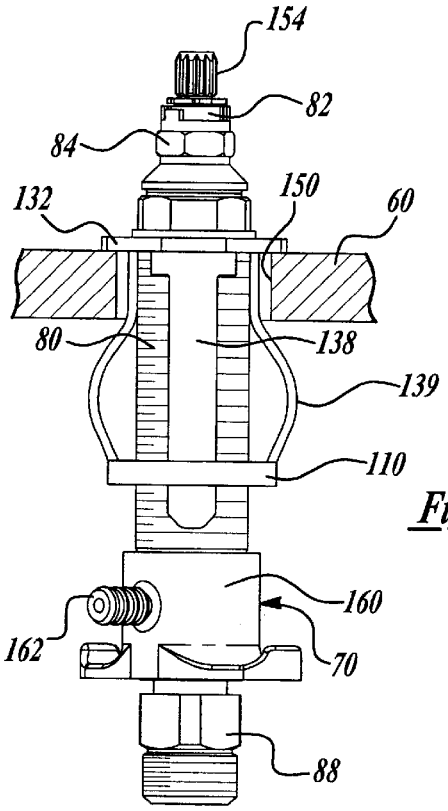
FIG. 11 is a second side view of the end body valve assembly with the retainer assembly in the engaged position according to the principles of the present invention.
Figure 16:
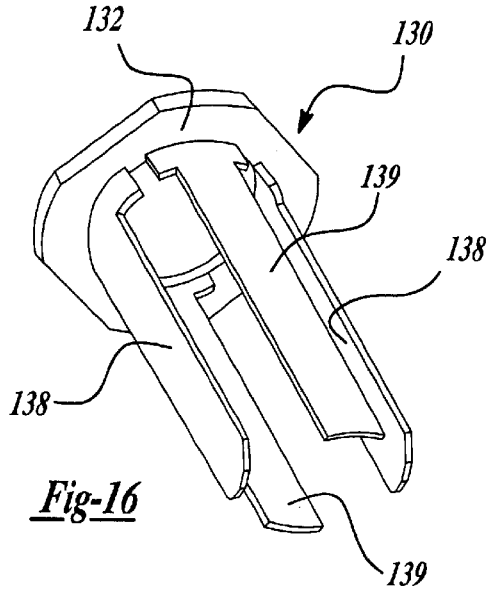
FIG. 16 is a perspective view of the nut guide and retainer assembly for use with the end body valve assembly according to the principles of the present invention.
Figure 17:
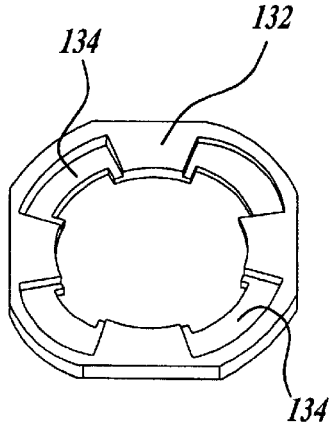
FIG. 17 is a perspective view of the guide flange of the nut guide and retainer assembly according to the principles of the present invention.
Figure 18:
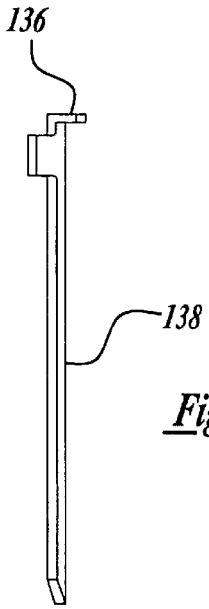
FIGS. 18 and 19 show side and front views, respectively, of the guide arm of the nut guide and retainer assembly according to the principles of the present invention.
Figure 19:
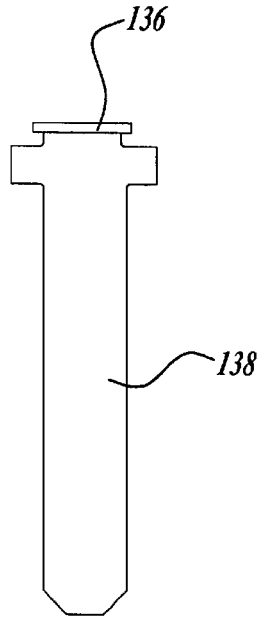

A nut guide assembly 130, as best shown in FIG. 16, is provided for guiding the threaded nut 110 and preventing rotation of the threaded nut 110. The nut guide assembly 130 includes a guide flange 132 which abuts against the radially extending flange 86 of threaded body 80. As best shown in FIG. 17, guide flange 132 includes a pair of recesses 134 which mate with an upper bend portion 136 of oppositely disposed guide arms 138, as best shown in FIGS. 18 and 19. As the guide flange 132 rests against the radially extending flange 86, the flange 86 helps to hold the upper bend portion 136 of the arms 138 in the recesses 134. The guide arms 138 extend through the guide recesses 112 in the threaded nut 110 to prevent the threaded nut 110 from rotating relative to the nut guide assembly 130. Accordingly, as the threaded body 80 is rotated, the threaded nut 110 is prevented from rotating relative to the nut guide assembly 130 therefore causing the threaded nut 110 to move upward and downward along the threaded body 80 depending upon the direction of rotation of the threaded body 80. The retainer assembly 108 includes a pair of legs 139 which extend between the guide flange 132 and the threaded nut 110. The legs 139 each include an upper bend portion 140 similar to upper bend portions 136 of guide arm 138. The upper bend portions 140 of the legs 139 engage recesses 142 in the guide flange 132. As the threaded nut 110 moves up and down along the threaded body 80 upon rotation of the threaded body 80, the legs 139 of the retainer assembly bend outward as illustrated in FIGS. 11 and 14 in order to encapsulate the end body valve assembly within the opening 150 of the deck 60.

During installation of the end body valve assembly 14, according to the principles of the present invention, the end body valve assembly 14 is inserted through an opening 150 in the deck or mounting surface 60. In order to securely fasten the end body valve assembly 14 to the deck 60, the guide flange 132 is held and the threaded body 80 is rotated in a clockwise direction in order to draw the threaded nut 110 upward so that the legs 139 bend outward against the underside of the deck 60 as shown in FIGS. 11 and 14. A wrench can be used to engage the hexagonal head portion 84 of the threaded body 80 in order to tighten the end body valve assembly 14 in place. The height is automatically set for proper handle height. A lever handle (not shown) would then be applied to the upper splined portion 154 of the valve 82 as is known in the art.

At this time, the end connector 70 is attached to the end body valve assembly 14 by sliding the connector 70 over the base portion 88 of the threaded body 80 and the connector clip 72 is inserted in the groove 104 for holding the connector 70 in place. Preferably, the interconnecting hoses 74 are preassembled to the end connectors 70 and T-connector 76, thus reducing the amount of time and work done under the sink where space is limited. The end connector 70, as best shown in FIG. 14, includes a generally cylindrical body portion 160 having a radially extending port neck 162 extending therefrom. Port neck 162 includes serrations 164 on an exterior surface thereof. The serrations 164 engage with the hose 74 to secure the hose 74 to the end connector 70. As an alternative, the connector 70 can be held in place by other known techniques such as a crimped fitting.

The T-connector 76, shown in FIG. 1, includes a body portion 168, as best shown in FIG. 5, connected to the waterway tube 18 and further having first and second hose connector portions 170 for connecting with the hoses 74. The body portion 168, as shown in FIG. 5, supports an O-ring 172 which surrounds the waterway tube 18 as well as a connector ring 174. The connector ring 174 includes a plurality of fingers 176 which extend longitudinally and are provided with radially inwardly extending end portions 178. The radially inwardly extending end portions 178 engage an annular groove 180 formed in the exterior surface of the waterway tube 18 in order to secure the T-connector 76, as best shown in FIG. 1, to the waterway tube 18. The T-connector 76 is commercially available from the PARFLEX Division of Parker Hannifin, 1300 N. Freedom Street, Ravenna, Ohio 44266.

Figure 20:
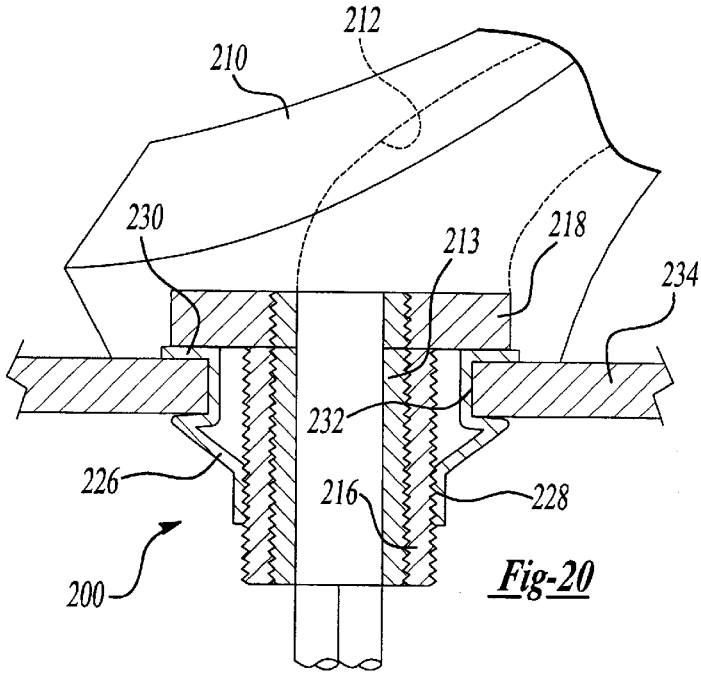
FIG. 20 is a side view of a second embodiment of the quick install spout assembly according to the principles of the present invention.
Figure 21:
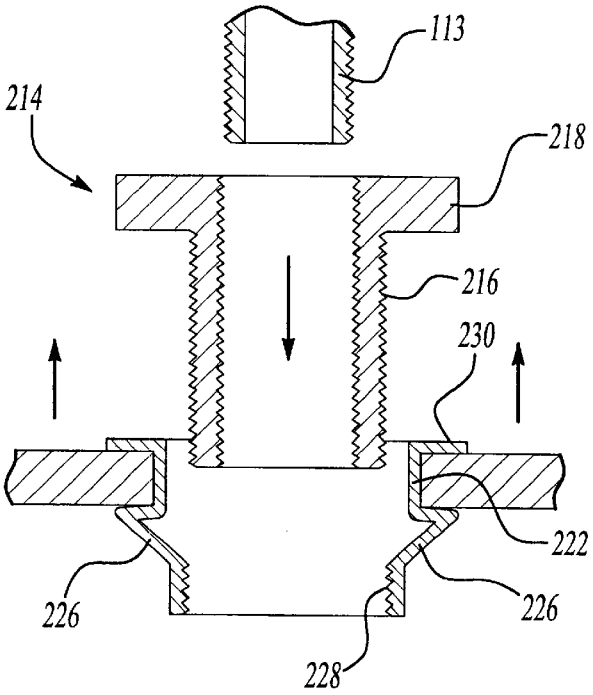
FIG. 21 is an exploded view of the quick install spout assembly shown in FIG. 20.
Figure 22:
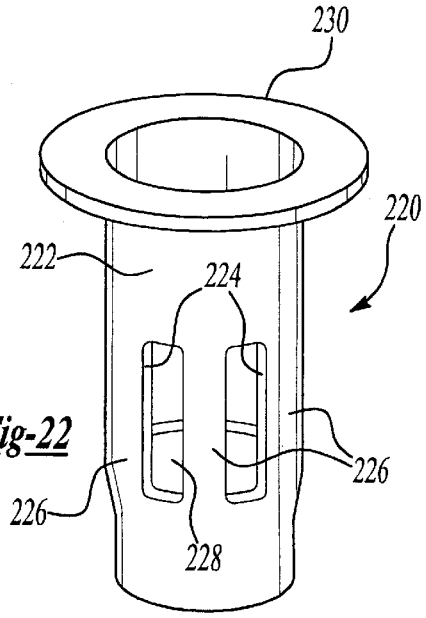
FIG. 22 is a perspective view of a retainer sleeve for use with the quick install spout assembly shown in FIG. 20.
Figure 23:
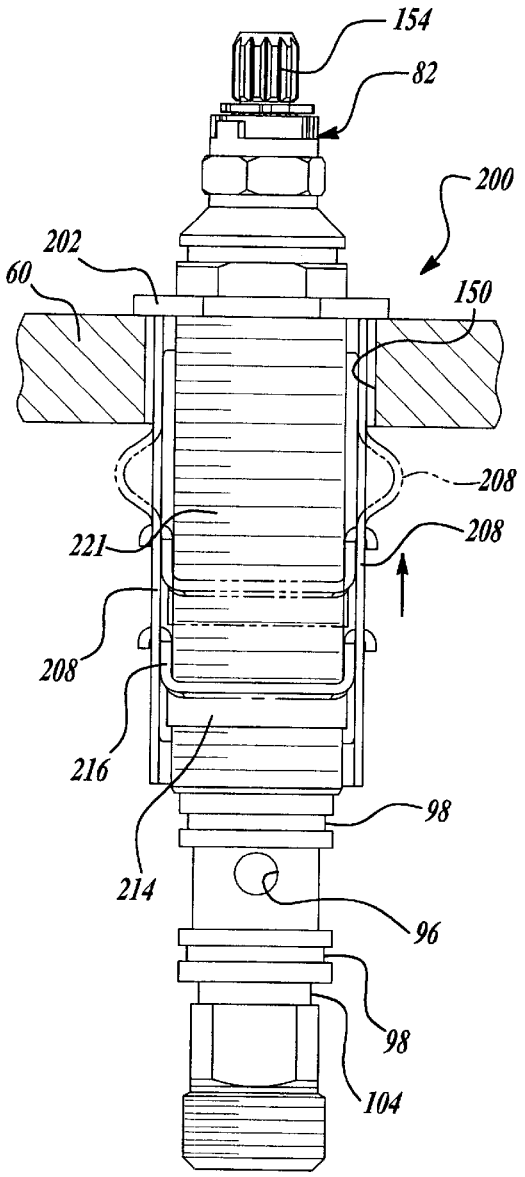
FIG. 23 is a first side view of a quick install end body valve assembly according to a second embodiment of the present invention.
Figure 24:
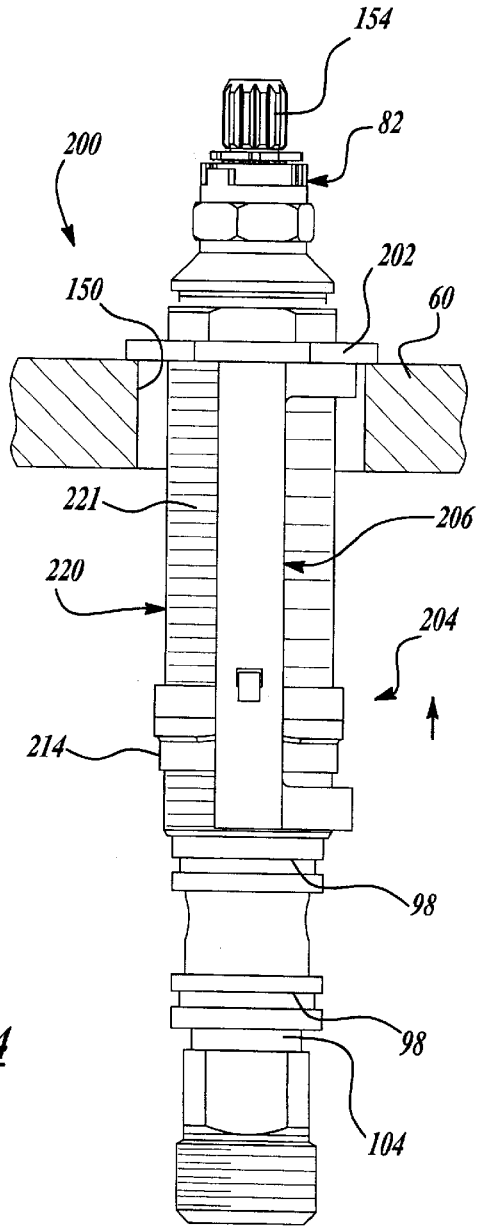
FIG. 24 is a second side view of the end body valve assembly shown in FIG. 23.

A second embodiment of the quick install faucet of the present invention is disclosed in FIGS. 20–22. The quick install faucet assembly 200 includes a faucet 210 which defines a water passage 212 therethrough. The faucet 210 is provided with a threaded shaft 213 which has an externally threaded surface which threadedly engages a threaded sleeve 214. The threaded sleeve 214 includes an internally and externally threaded cylindrical body portion 216 and a radially extending flange portion 218. The externally threaded portion of the threaded sleeve engages a compression retainer sleeve 220. The compression retainer sleeve 220, best shown in FIG. 22 includes a cylindrical body portion 222 including a plurality of slots 224 defining a plurality of retainer legs 226. A bottom portion of the cylindrical body portion 222 includes internal threads 228 which are engaged by external threads of threaded sleeve 214. The compression retainer sleeve 220 also includes a radially extending flange 230 at an upper portion of the cylindrical body portion 222.

During installation, the compression retainer sleeve 220 is inserted in an opening 232 in the deck 234 so that the flange 230 is seated above the deck 234. The threaded sleeve 214 is then inserted in the compression retainer sleeve 220 such that the externally threaded portion engages the internal threads 228. As the threaded sleeve 214 is engaged 20 with the internal threads 228 of the compression retainer sleeve and the flange portion 218 of the threaded sleeve 214 engages the flange portion 230 of the compression retainer sleeve 220, continued rotation of the threaded sleeve 214 will cause the retainer legs 226 to buckle outwardly until the retainer legs 226 engage the underside of the deck 234, as best shown in FIG. 20.

With reference to FIGS. 23–26, a second embodiment of the end body valve assembly 200 will be described. The end body valve assembly 200 is attached to a sink or deck by an upper bracket 202 and a lower nut retainer 204, best shown in FIG. 23. The upper bracket 202 is not threaded and is attached to a bracket 206. The bracket 206 includes a pair of long arms 208 each with an opening 210 at the lower end thereof . The lower nut retainer 204 has a pair of arms 212 which extend laterally outward and includes a threaded body portion 214. The arms 212 are received in the openings 210 of arms 208 such that the lower nut 204 extends between the two openings 210.

Figure 25:
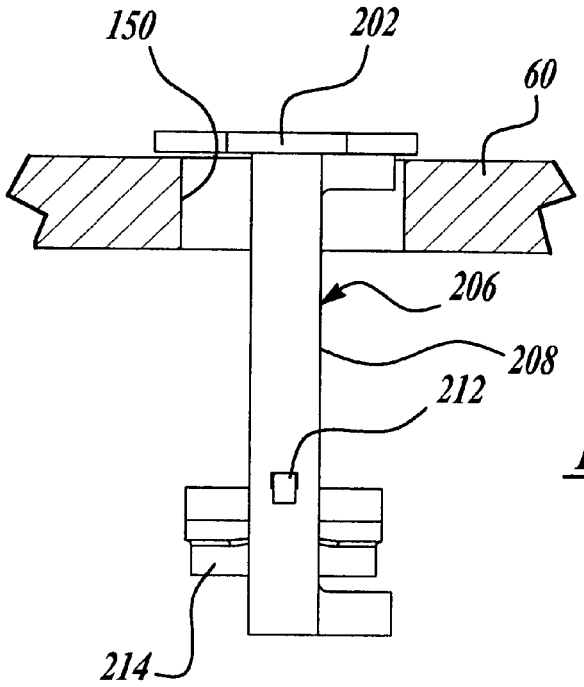
FIG. 25 is a first side view of the bracket and nut assembly shown in FIG. 23.
Figure 26:
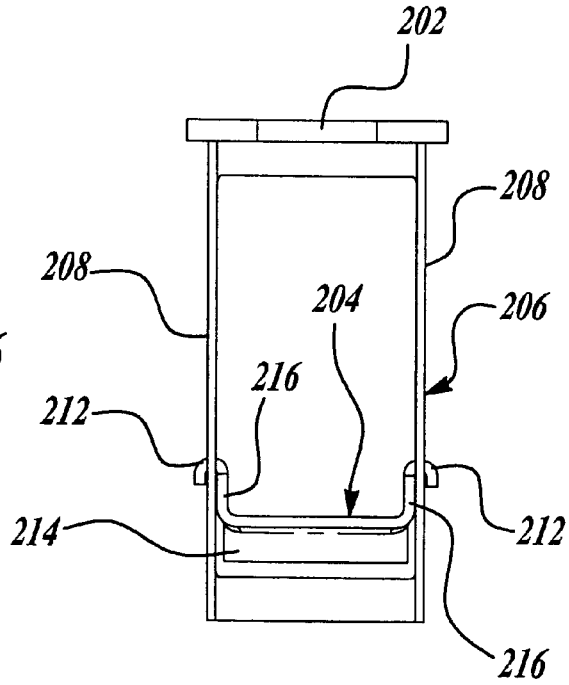
FIG. 26 is a second side view of the bracket and nut assembly shown in FIG. 25 inserted in an opening in the deck.

During installation of the valve body assembly 200 the lower nut 204 and bracket 206 are inserted through the opening 150 in the deck 60 as best shown in FIG. 25. An end body 220 is then inserted through a center of the upper bracket 202 and lowered to the lower nut retainer 204. The end body 220 includes a threaded outer surface 221 such that upon rotation of the end body 220, the end body 220 engages the lower nut retainer 204. To tighten the end body 220 to the deck, the upper bracket 202 can be held in place while the threaded valve body 220 is rotated. The valve body rotation causes the lower nut retainer 204 to move up the threaded valve body 220 forcing the arms 212 to bend outward until the deck 60 is sandwiched by the upper bracket 202 and outwardly bent arms 208 as shown in phantom in FIG. 23. In this embodiment, the end body 220 supports a valve 82 and an internal spacer tube 92 in the same manner as shown in FIG. 14.

The quick connect faucet assembly, according to the principles of the present invention, provides an installation which is much faster than conventional faucets. Furthermore, installation is simplified since all components are tightened from above the sink.

The quick install faucet assembly of the present invention has no loose parts that can be misplaced. The end body and spout can be preassembled and ready for installation by the user.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for installing a fixture on a top side of a deck having at least one mounting hole therein, comprising:

a threaded member engaged with the fixture and extending through the mounting hole to be rotated from above the deck;

a nut threadedly connected to the threaded member to pass through the mounting hole to the underside of the deck;

at least one retainer leg extending between an upper portion of said threaded member and said nut; and a second member associated with and parallel to the threaded member, the second member engaging the nut to prevent rotation thereof during rotation of the threaded member whereby the nut will be shifted up or down along the length of the threaded member responsive to the direction of rotation of the threaded member;

wherein upon rotation of the threaded member to raise the nut in the direction of the deck, the nut causes said retainer leg to bend outward such that a portion of said retainer leg engages the underside of the deck to clamp the fixture to the deck.

2. The apparatus according to claim 1, wherein the second member includes a top disc journaled to the threaded member and at least one guide arm connected to the top disc which extends parallel to the threaded member.

3. The apparatus according to claim 2, wherein said nut has a recess through which the guide arm extends to prevent the nut from rotating during rotation of the threaded member whereby the nut will be caused to be shifted toward or away from the deck upon rotation of the threaded member.

4. The apparatus according to claim 1, wherein the second member defines a waterway to the fixture.

5. The apparatus according to claim 1, wherein:

the fixture defines a spout;

the second member threadedly engages the spout;

a connecting plate is provided including a pair of holes one through which the second member passes and the other through which the threaded member passes;

the connecting plate non-movably clamped to the spout by the second member;

the threaded member having an enlarged head which sits atop the plate and which is turnable therein to raise or lower the wedge nut thereon.

6. The apparatus according to claim 1, wherein:

the fixture defines an end body having a valve therein.

7. An apparatus for installing a fixture on a top side of a deck having at least one mounting hole therein, comprising:

a bracket member having a first portion extending through the mounting hole and a second portion resting on the top side of said deck, said first portion including a pair of parallel arms;

a nut retainer including a threaded body portion engaging an end of said pair of parallel arms of said first portion of said bracket member; and a threaded member engaged with the fixture and extendable through said second portion of said bracket member and engagable with said threaded body portion of said nut retainer whereby, upon rotation of the threaded member, the nut retainer rises in the direction of the deck such that the arms of said first portion of said bracket member bend outwardly to engage the underside of the deck to clamp the fixture to the deck.

8. The apparatus according to claim 7, wherein said retainer portion of said nut retainer includes a pair of retainer arms extending on opposite sides of said threaded body portion.

* * * * *